US012253269B1

(12) United States Patent
Schmitt

(10) Patent No.: US 12,253,269 B1
(45) Date of Patent: Mar. 18, 2025

(54) BUILDING HEATING SYSTEM

(71) Applicant: EGO IP B.V., Den Ilp (NL)

(72) Inventor: Emile Volkert Henningh Schmitt, Den Ilp (NL)

(73) Assignee: EGO IP B.V., Den Ilp (NL)

( * ) Notice: Subject to any disclaimer, the term of this patent is extended or adjusted under 35 U.S.C. 154(b) by 0 days.

(21) Appl. No.: 18/606,109

(22) Filed: Mar. 15, 2024

(30) Foreign Application Priority Data

Dec. 13, 2023 (EP) ..... 23216458

(51) Int. Cl.

| | |
|---|---|
| ***F24D 3/08*** | (2006.01) |
| ***F24D 3/18*** | (2006.01) |
| ***F24H 1/10*** | (2022.01) |
| ***F24H 15/132*** | (2022.01) |
| ***F24H 15/215*** | (2022.01) |
| ***F24H 15/238*** | (2022.01) |

(52) U.S. Cl.
CPC ..... *F24D 3/08* (2013.01); *F24D 3/18* (2013.01); *F24H 1/101* (2013.01); *F24H 15/132* (2022.01); *F24H 15/215* (2022.01); *F24H 15/238* (2022.01); *F24H 2250/08* (2013.01)

(58) Field of Classification Search
None
See application file for complete search history.

(56) References Cited

U.S. PATENT DOCUMENTS

| | | | | |
|---|---|---|---|---|
| 10,443,861 | B2 * | 10/2019 | Dostal | G05D 23/1931 |
| 2003/0007790 | A1 * | 1/2003 | Harris | F24H 7/0433 392/479 |
| 2017/0211862 | A1 * | 7/2017 | Slack | F24H 15/414 |

FOREIGN PATENT DOCUMENTS

| | | |
|---|---|---|
| EP | 2103890 B1 | 9/2013 |
| EP | 2103879 B1 | 7/2015 |
| EP | 1767879 B1 | 9/2017 |
| EP | 3115699 B1 | 5/2019 |
| FR | 2935781 A1 | 3/2010 |

OTHER PUBLICATIONS

Extended European Search Report issued on Apr. 23, 2024, in corresponding European Application No. 23216458.2, 8 pages.

* cited by examiner

*Primary Examiner* — Carlos R Ortiz Rodriguez
(74) *Attorney, Agent, or Firm* — Maier & Maier, PLLC

(57) ABSTRACT

A building heating system, including for heating water, such as tap water and/or utility water, of a building water system. The embodiments also relate to a kit of part to realize such a building heating system. The embodiments further relate to a method for controlling the building heating system.

19 Claims, 2 Drawing Sheets

BUILDING HEATING SYSTEM

FIELD

The invention relates to a building heating system, in particular for heating water, such as tap water and/or utility water, of a building water system. The invention also relates to a kit of parts to realize such a building heating system. The invention further relates to a method for controlling the building heating system according to the invention.

BACKGROUND

Conventional residential heating systems typically comprise a single centralized heat source, like a gas boiler, from which heat is supplied to a number of recipients within the building. These systems are relatively low in efficiency due to significant losses introduced by transporting heat over a large distance through the building whenever a recipient initiates a heat request.

More recently, environmental aspects have become an essential consideration in residential heating system applications. This results in a shift towards using green energy sources, minimizing gas consumption and reducing emission of harmful substances, such as $CO_2$. In general, decreasing energy use and more importantly energy losses, has taken a central role in building heating system design.

SUMMARY

It is a first objective of the invention to provide a building heating system which overcomes at least one drawback of the prior art.

It is a second objective of the invention to provide a relatively energy-efficient building heating system.

It is a third objective of the invention to provide a relatively energy-efficient building heating system which can be controlled in a flexible manner.

It is a fourth objective of the invention to provide a relatively environmental-friendly building heating system.

At least one of these objectives can be achieved by providing a building heating system, comprising:

- at least one heat pump, preferably an air source heat pump, configured to transfer heat from a source fluid, such as air, in particular outside air, to a working fluid conducted through a working fluid line,
- wherein said working fluid line comprises at least two electrical heating tubes and/or at least two (alternative) auxiliary heat sources, configured to heat said working fluid during flow-through of said working fluid, wherein each of said heating tubes and/or at least two (alternative) auxiliary heat sources is, directly or indirectly, connected or connectable to said heat pump, and wherein said working fluid line is connected or connectable to at least one water heat exchanger for transferring heat from said working fluid to water, in particular tap water and/or utility water, conducted through at least one water line of a building water system,
- at least one temperature sensor configured to measure the temperature of the working fluid and/or water conducted through at least one water line,
- at least one control unit connected or connectable to said at least one temperature sensor, wherein said control unit is configured to, preferably individually, control the electrical heating tubes and/or the heat pump at least partially based upon the temperature detected by said at least one temperature sensor.

The building heating system according to the invention has a plurality of advantages. The heating system no longer requires the use of gas boilers or oil boilers, which reduces the emission of the heating system according to the invention to zero. Moreover, since a heat pump is used, the working fluid can be heated in a relatively energy-efficient manner.

Preferably, an air source heat pump is used, which is configured to extract heat energy from air, preferably outside air, to subsequently transfer at least a substantial part of the extracted heat to the working fluid. A further advantage of the building heating system according to the invention is that the heating system is configured, by means of its control unit, to modularly control, in particular switch on or off, heat sources, like the heating tubes and/or the heat pump. By means of one or more temperature sensors, the temperature can be measured at various locations within the heating system, which serves as input for the (pre-programmed) control unit to, preferably individually, control the heating components of the heating system, including the heating tubes and/or the heat pump. This makes it possible, for example, in case the measured temperature of the working fluid and/or water is below a threshold value to switch on one or more heating tubes and/or the heat pump to further heat the working fluid and/or water to a desired temperature level. Additionally, it makes it possible, for example, in case the measured temperature of the working fluid and/or water is above a threshold value to switch off one or more heating tubes and/or the heat pump to reduce (unnecessary) energy consumption. The working fluid acts as an intermediary heat transfer fluid to transfer heat from a source fluid, such as (outside) air, to water conducted through at least one water line of the building water system. Examples of such water lines are a tap water line and a central heating line. The working fluid may be any suitable fluid, preferably a liquid. This may be a single-component working fluid (e.g. water, glycol, or ammonia), or may be a multi-component working fluid, such as a mixture of water and ammonia. The working fluid line is preferably a closed circuit, wherein the working fluid is able to circulate, preferably by using a working fluid pump in the working fluid line. It is imaginable the that working fluid line, in particular the working fluid circuit, forms part of the central heating line of the building water system. Here, the working fluid circuit may be water, which water is heated by the heat pump and/or the heating tubes and/or the (alternative) auxiliary heat sources. This heated water of the working fluid line may be directly used to heat the building (at least partially) as well to transfer heat to tap water of a tap water line.

The building heating system according to the invention can be used for example as residential heating system, in particular home/domestic heating system, or as commercial heating system.

Preferably, the system comprises a plurality of temperature sensors connected or connectable to said control unit, wherein at least one working fluid temperature sensor is configured to measure the temperature of the working fluid downstream of the heat pump and an upstream side of the heating tubes, and wherein at least one other working fluid temperature sensor is configured to measure the temperature of the working fluid downstream of the heating tubes. Optionally, at least one working fluid temperature sensor is configured to measure the working fluid temperature of the working fluid upstream of the heat pump. The application of a plurality of working fluid sensors allows measuring of the working fluid temperature at various locations in the working fluid line, which leads to additional input for the control unit to control the heating system. The aforementioned positioning of different working fluid temperature sensors leads to information regarding the temperature of the working fluid heated by the heat pump, and the additional heat, if any, added to the working fluid by the one or more heating tubes. This also provides information regarding the heat power generated by the one or more (switched on) heating tubes, and the yield of said heating tubes.

In a preferred embodiment, the system comprises a plurality of temperature sensors connected or connectable to said control unit, wherein at least one working fluid temperature sensor is configured to measure the temperature of the working fluid, and wherein at least one water temperature sensor is configured to measure the temperature of water of conducted through at least one water line of the building water system. By (also) directly measuring the water temperature of at least one (hot) water line of the water building system, it can be concluded by the control unit whether the water temperature is sufficiently high to fulfil specific needs or requirements. The water temperature sensor(s) may be existing water temperature sensor in an already installed traditional building heating system or may be new water temperature sensor(s). The water temperature sensor(s) used in the heating system allow improved (more sophisticated) control of the heating tubes and optionally the heat pump, in case the control unit is configured to communicate, in particular to retrieve information, from the water temperature sensor(s).

The heating system preferably comprises a plurality of water temperature sensors connected or connectable to said control unit, wherein at least one water temperature sensor is configured to measure the temperature of water of conducted through at least one first (hot) water line, such as a (hot) tap water line, and wherein at least one other water temperature sensor is configured to measure the temperature of (hot) water of conducted through at least one second (hot) water line, such as a central heating water line. Contrary to the tap water line, the central heating water line is usually a closed water circuit.

The heating system may comprise at least one pressure sensor connected or connectable to the control unit, wherein the at least one pressure sensor is configured to measure the pressure of the working fluid. This makes it possible, for example, when the measured pressure of the working fluid is above a threshold value to control the heating system by for example switching off one or more heating tubes and/or the heat pump. The heating system may comprise at least one water pressure sensor connected or connectable to the control unit, wherein the at least one water pressure sensor is configured to measure the pressure of water. This makes it possible, for example, when the measured pressure of the water is below a threshold value to refill the water line with water.

Furthermore, the control unit may be configured to determine the flow of the working fluid and/or the water. The control unit may determine the flow based on the measured temperature and/or on the measured pressure by the temperature sensor(s) and/or pressure sensor(s), respectively. It is imaginable that the heating system comprises at least one flow rate sensor connected or connectable to the control unit, wherein the at least one flow rate sensor is configured to measure the flow rate of the working fluid and/or at least one flow rate sensor configured to measure the flow rate of the water.

Preferably, at least two heating tubes are positioned at a downstream side of the heat pump and an upstream side of the at least one heat exchanger. As the heat pump typically acts as a primary heat source, and the heat tubes act as secondary heat sources to further heat the working fluid (if necessary), such as positioning of components is preferred as this allows measuring the temperature of the working fluid directly downstream of the heat pump to decide whether the heating tubes should be switched on as well, and if so, which heating tubes should be switch on as well, to bring the temperature of the working fluid to a desired level. However, this does not take away the possibility that at least two heating tubes are or could be positioned at an upstream side of the heat pump and at a downstream side of the at least one heat exchanger. It is imaginable that the heating tubes act as primary heat sources, and the heat pump acts as a secondary heat source to further heat the working fluid (if necessary). This makes it possible, for example, in case the measured temperature of the working fluid and/or water is below a threshold value to switch on the heat pump to further heat the working fluid and/or water to a desired temperature level. Additionally, it makes it possible, for example, in case the measured temperature of the working fluid and/or water is above a threshold value to switch off the heat pump to reduce (unnecessary) energy consumption. A combination is also imaginable wherein one or more heating tubes is/are positioned, preferably directly, downstream of the heat pump and wherein one or more other heating tubes is/are positioned, preferably directly, upstream of the heat pump. It is imaginable to position one or more heating tubes relatively close to and at an upstream side of the heat exchanger to reduce loss of heat during transportation of the heated working fluid through the working fluid line, which is advantageous from an energetic point of view. To this end, relatively close may for example be less than 10 meter, preferably less than 7 meter, more preferably less than 5 meter, even more preferably less than 4, 3, 2, or 1 meter as measured along the working fluid line.

The electrical heating tubes used in the heating system according to the invention are designed for flow-through of the working fluid. During flow-through of the working fluid, the working fluid can be heated by the heating tubes (when activated by the control unit).

It is commonly preferred that at least two heating tubes, such as two, three, or four heating tubes, are connected in parallel orientation in the working fluid line. Preferably, a diameter of at least one heating tube, preferably each heating tube, is smaller than a diameter of an, preferably each, adjacent (main) conduit of the working fluid line. More preferably, the sum of diameters of the parallel heating tubes is larger than a diameter of an, preferably each, adjacent conduit of the working fluid line. This allows the working fluid flow rate to drop within the heating tubes, which lengthens the residence time of the working fluid within the heating tubes, which intensifies the heat transfer from the heat tube(s) to the working fluid.

Additionally or alternatively, it is also imaginable that at least two heating tubes are connected in series in the working fluid line. Here, it is imaginable that various heating tubes are integrated into a single heating tube having a plurality of, preferably individually controllable, heating sections. Each heating section may, for example, by formed and/or comprise a heating coil, which coils are oriented in series (one coil being positioned downstream of the other coil as seen in the working fluid flow direction). Each heating coil is thereby preferably wound around the same tube (body).

Preferably, at least one electrical heating tube is an induction heating tube. The induction heating tube is configured to heat the working fluid by means of induction heating. Induction heating uses the principle of the action of the electromagnetic field described by Maxwell's equations on ferromagnetic material. The electrically conductive object, here an electrically conductive tube, is inserted into the alternating electromagnetic field of the induction coil during the induction heating through which the alternating current passes. As a result of electromagnetic induction, swirled currents are induced in the heated tube, which have the opposite orientation as the current in the induction coil. Heating occurs due to resistive and hysteresis losses, the proportion of electrical and magnetic components depending on the electrical and magnetic properties of the heated material. The heat is generated directly inside the material of the tube, which is subsequently be transferred at least partially to the working fluid. The tube and the inductor (surround coil) are not in direct mechanical contact with each other to prevent short-circuiting.

Hence, preferably, said induction heating tube comprises at least one coil connected or connectable to an alternating current source, wherein said at least one coil is wound, preferably at a coupling distance, around an electricity conductive tube, such as a metal tube, in particular a copper and/or a steel tube. It may be preferred that said induction heating tube is connected or a connectable to an alternating current source, such as the mains (with a default frequency of 50 Hz), wherein at least one frequency converter is positioned in between the alternating current source and said induction heating tube, wherein said frequency converter is configured to increase a default frequency value of the alternating current source to a higher frequency value. The frequency converter, if applied, is preferably configured to produce a frequency which is x times the default frequency of the alternating current source, wherein x is preferably at least 100, more preferably at least 1,000.

Additionally or alternatively, at least one electrical heating tube may be an electrical resistance heating tube or an Ohmic heating tube comprising at least one electrical resistance heating element, such as a heating coil, configured to generate heat to be transferred to the working fluid conducted through said heating tube. Said heating element is preferably connected or connectable to an electrical power source. The heating element may e.g. be a heating coil or heating strip, which may be positioned either around and/or inside at least one heating tube for flow-through of the working fluid.

Each heating tube is preferably configured to generate at least 1 kW, preferably between 1 and 5 kW, more preferably between 2 and 4 KW, of heating power. The total assembly of heating tubes is configured to generate between 2 and 10 kW (or even more than 10 KW), preferably between 4 and 7 kW, of heating power. Each heating tube and/or the total assembly of heating tubes (or alternative auxiliary heating sources) may be configured to generate at least 10 kW of heating power. The heat pump is preferably configured to generate between 1 and 5 kW, preferably between 1 and 3.5 kW, of heating power. Preferably, the ratio of the power input and the power output of the heat pump is between 6:11 and 1:5. The ratio of the power input and the power output of the heating system (heat pump, and heating tubes, and control unit) is between 60:61 and 2:3.

It is imaginable that the working fluid line comprises at least one alternative auxiliary heat source to (at least partially heat) the working fluid. The working fluid line may comprise the at least one auxiliary heat source instead of or in addition to at least one of the at least two heating tubes and/or instead of or in addition to the heat pump. It is conceivable that instead of the at least two heating tubes, the working fluid line comprises at least one heat source. Preferably, the heat source is configured to heat the working fluid electrically and/or by means of green energy or renewable energy. However, it is also imaginable that the heat source is configured to heat the working fluid by means of a fossil fuel. At least one auxiliary heat source may for example be a solar heater, a geothermal heater, an additional heat pump, and the like.

The control unit is preferably configured to individually switch on and off the electrical heating tubes and/or one or more parts of a heating tube, dependent on one or more temperature values measured by one or more temperature sensors, preferably including temperature values relating to the temperature of the working fluid and the water heated and/or to be heated. Preferably, the control unit acts as central and sole control unit. Preferably, the control unit is configured to communicate with each temperature sensor of the heating system. This communication between the control unit that at least one, preferably each, temperature sensor and/or the heating tubes and/or the heat pump may be either wired and/or wirelessly. The control unit is preferably (also) configured to communicate building heating system related data to at least one external device, such as a display, an external computer, a smartphone, and/or a tablet to allow persons to monitor the status of the heating system and optionally to modify the programming of the control unit and hence the control of the building heating system.

The control unit, which may be e.g. a programmable logic controller (PLC) and/or an energy management system (EMS), is preferably pre-programmed. Non-limitative examples of the control by the control unit will be described below. Preferably, the system comprises at least one water temperature sensor being configured to measure the temperature of water of conducted through at least one first water line, such as a tap water line, wherein the control unit is configured to switch on at least one electrical heating tube in case the measured water temperature is below a first threshold value and simultaneously or successively to switch on at least one further heating tube in case the measured water temperature is below a second threshold value, wherein said second threshold value is lower than said first threshold value.

Additionally or alternatively, the system preferably comprises at least one water temperature sensor configured to measure the temperature of water of conducted through at least one first water line, such as a tap water line, as well as at least one flow sensor to measure the flow of water through said first water line, wherein the control unit is configured to switch on at least one electrical heating tube in case the measured water temperature is below a temperature threshold value and/or in case the measured water flow exceeds a flow threshold value, and wherein the control unit is further configured to simultaneously or successively to switch on at least one further heating tube in case the measured water flow exceeds a, preferably predefined, period of time and/or in case the measured temperature increase over a predefined period of time remains below a temperature threshold value. Additionally or alternatively, the control unit may be configured to act as PID controller and/or may comprise at least one PID controller to control one or more heating tubes and optionally the heat pump. A PID controller (a proportional-integral-derivative controller) continuously calculates an error value as the difference between a desired setpoint (SP) (which may be considered as threshold value) and a measured process variable (PV) and applies a correction based on proportional, integral, and derivative terms (denoted P, I, and D respectively). This PID output signal, which is typically an analog signal, may be converted into a discrete signal (ON or OFF signal) and/or may be used to generate a discrete signal (ON or OFF signal).

The heat pump is preferably an air source heat pump. This air source heat pump typically comprises at least one compressor, at least one condenser, and at least one expansion device, in particular at least one expansion valve, and at least one evaporator, connected by fluid conduits carrying a heat pump fluid, wherein the evaporator is provided with an air intake duct and an air outlet duct, wherein the heat pump further comprises an air fan which is preferably provided in or connected to the air inlet duct. The heat pump fluid may, for example, comprise one or more chlorofluorocarbons, one or more hydrochlorofluorocarbons, one or more fluorocarbons, propane, butane, isobutane, ammonia, sulphur dioxide, or mixtures thereof. The heat pump fluid may be a liquid, a gas, or combination thereof. The condenser is preferably provided with at least one working fluid duct making part of the working fluid line, wherein said working fluid duct is preferably connected to the heating tubes. The heat pump may be connected to an existing air inlet pipe and existing air outlet pipe (e.g. an existing flue gas outlet pipe), which inlet and outlet pipes may have been connected before to a fuel boiler, such as a gas boiler, and which are now (re-)used to connect the heat pump as a more environmental-friendly option compared to the fuel boiler.

Preferably, the existing flue gas discharge pipe or the existing air inlet pipe or the assembly of said existing flue gas discharge pipe and said existing air inlet pipe is connected to an air intake duct of the heat pump to conduct air into the heat pump. It is conceivable that an air outlet (duct) of the heat pump may be free from any connection to existing pipes and/or existing openings and may discharge cooled air directly into a building space (a room) where the heat pump is located. It is imaginable and even preferable that at least one pipe adapter is placed in between the heat pump and an existing air inlet pipe and/or an existing air outlet pipe. The pipe adapter may, for example, be a branched connecting tube, such as a Y-branched connecting tube or a T-branched connecting tube. Preferably, the pipe adapter, in particular connecting tube, comprises an inner tube portion and an outer tube portion which concentrically surrounds at least a part of the inner tube portion. Preferably, the existing air inlet pipe concentrically encloses at least a part of the existing flue gas outlet pipe to take advantage of the relatively high enthalpy of the flue gas to preheat the fresh inlet air. In boiler-based configuration, this leads to a considerable reduction of the discharge temperature of the flue gas and an increase of the fresh air inlet temperature. This reduces the thermal difference, as a result of which a boiler can achieve the same heat result using less energy. When connecting the heat pump to these existing pipes (after removal of the boiler), the existing air inlet pipe (for air to be cooled) is preferably connected to an air outlet opening of the heat pump and the existing air outlet pipe (for cooled air) is preferably connected to an air inlet opening of the heat pump. Hence, compared to the boiler, the heat pump may inversely be connected to the existing air pipe assembly. It is also imaginable that the assembly of said existing flue gas discharge pipe and said existing air inlet pipe is connected to the air intake duct of the heat pump to conduct air into the heat pump. This will generally increase the air intake capacity, and hence the effective capacity of the heat pump.

It is imaginable that the heat pump comprises a housing, wherein at least two heating tubes are connected to said housing and/or are accommodated within said housing. This allows the combination of the heat pump and at least two heating tubes to be produced, sold and installed as a heating system unit. This may seriously facilitate installation of the heating system. The housing may be a substantially closed housing, or an open housing, and may even be formed at least partially by a shared support structure for supporting the heat pump and the heating tubes.

The heat pump is typically connected or connectable to an electrical power source. It is imaginable that the system comprises at least one solar power generator for powering the heat pump and the heating tubes at least partially.

The working fluid line preferably comprises at least one storage container for (temporarily) storing heated working fluid, wherein said storage container is preferably configured for flow-through of working fluid during circulation of working fluid in the working fluid line. The storage container may be a buffer tank and/or a storage vessel. Preferably, the storage container has a (working) fluid storage volume of at least 45 litre. The storage container may, for example, have a working fluid storage volume of between 100 and 150 litre, such as 120 litre. The maximum temperature of the working fluid within the storage container is typically 95 degrees Celsius. Preferably, a part of at least one water line is guided through said storage container for preheating water by said working fluid within said storage container. This may, for example, preheat relatively cold water having a minimum temperature of 10 degrees Celsius to a temperature of between 10 and 75 degrees Celsius. The conduct part of the water line enclosed by the storage container is preferably coil-shaped to increase the length of the conduct part, and hence the heat transfer capacity from the working fluid to the water.

The heating system preferably comprises at least one water pump for pumping water through at least one water line of the building water system. Typically, each water line is provided with its own water pump. Preferably, the system comprises a plurality of separated water lines of the building water system, wherein each of at least two water lines are connected to a water heat exchanger for heating water by the working fluid.

The working fluid to water heat exchanger is preferably a plate heat exchanger, more preferably a counter-flow plate heat exchanger wherein the working fluid and the water to be heated are conducted in counter-flow through the plate heat exchanger. Preferably, the building water system comprises at least one tap water line and at least one central heating water line, wherein each of said lines are connected to a water heat exchanger for heating water by the working fluid. Preferably, the tap water related heat exchanger is positioned directly downstream of the heat tubes to allow practically instantaneously delivery of hot tap water when needed. The central heating system related heat exchanger may be positioned downstream of the tap water related heat exchanger as this central heating system normally does not require sudden peak demands of hot water.

Preferably, the system comprises at least one safety circuit configured to detect overheating and/or boiling dry of the working fluid line and for switching off the heat pump and the heating tubes in case overheating and/or boiling dry of the working fluid line is detected, wherein said safety circuit is preferably unconnected to the control unit.

The invention also relates to a kit of parts for a building heating system according to the invention, comprising:

at least one heat pump, at least two working fluid heating tubes connectable, directly of indirectly, to said heat pump, at least one working fluid temperature sensor, and at least one control unit connectable to said at least one temperature sensor, wherein said control unit is configured to individually control the electrical heating tubes and optionally the heat pump at least partially based upon the working fluid temperature detected by said at least one working fluid temperature sensor.

The invention further relates to a method, in particular a computer-implemented method, for controlling the building heating system according to the invention, comprising the step of, operating the control unit to individually control and/or switch on and/or off, one or more electrical heating tubes and optionally the heat pump, at least partially based upon at least one temperature detected by said at least one temperature sensor. Preferably, the control unit receives during this step a plurality of temperature values originating from different temperature sensors, and optionally one or more pressure values originating from one or more pressure sensors, to control the heat tubes and optionally the heat pump. Examples of such control have been give above and are described below in more detail. For example, if the hot water demand is suddenly increasing and the working fluid temperature is too low (below a predefined temperature threshold value), one or more heat tubes—dependent on the heat energy needed at that moment—are switched on by the control unit. And if the hot water demand is (suddenly) decreasing, the control unit may switch one or more heat tubes off. In case a measured pressure in the working fluid line and/or at least one water line is too low (below a predefined pressure threshold value), the control unit may be programmed to switch off the heat tubes and optionally the heat pump. Hence, the control unit is programmed with computer-readable instructions configured to operate the building heating system. These instructions may include all data required to allow the control unit to autonomously control the building heating system. This typically includes all basic measuring and control instructions as well as situation dependent parameters (such as the heat capacity and/or diameters of the heat tubes and the capacity of the heat pump). These data are normally stored on at least one storage medium and/or memory of the control unit. It is optionally imaginable that a part of said data, such as the situation dependent parameters, are not stored within the control unit, but are externally stored in a computer network and/or are stored in the Internet Cloud, wherein the control unit has access to said externally stored data.

The invention moreover relates to a computer program product comprising a non-transitory computer-readable medium having stored thereon computer-readable instructions for the control unit for operating the building heating system according to the invention. Preferably, the computer-readable medium makes part of the control unit. These instructions typically comprise code for receiving sensor values originating from one or more sensor, including one or more temperature sensors, of the building heating system, and code to, preferably individually, control the heat tubes and optionally the heat pump, based upon the received sensor values and preferably based upon at least one decision-making algorithm. This computer program product, optionally at least partially prestored on a control unit, may optionally be marketed separately from the heat pump and the heat tubes. Also this aspect of the present disclosure provides similar advantages as discussed above in relation to the previous aspects of the present disclosure. Said computer-readable medium may be any type of memory device, including, for example, one or more of a removable non-volatile random-access memory, a hard disk drive, a floppy disk, a CD-ROM, a DVD-ROM, a USB memory, an SD memory card, or a similar computer-readable medium known in the art.

Further embodiments of the invention are described in the non-limitative set of clauses presented below.

CLAUSES

1. Building heating system, comprising:

at least one air source heat pump configured to transfer heat from air, in particular outside air, to a working fluid conducted through a working fluid line, wherein said working fluid line comprises at least two electrical heating tubes and/or at least two (alternative) auxiliary heat sources configured to heat said working fluid during flow-through of said working fluid, wherein each of said heating tubes and/or at least two (alternative) auxiliary heat sources is, directly or indirectly, connected or connectable to said heat pump, and wherein said working fluid line is connected or connectable to at least one water heat exchanger for transferring heat from said working fluid to water, in particular tap water and/or utility water, conducted through at least one water line of a building water system, at least one temperature sensor configured to measure the temperature of the working fluid and/or water conducted through at least one water line, at least one control unit connected or connectable to said at least one temperature sensor, wherein said control unit is configured to individually control the electrical heating tubes and/or the heat pump based upon the temperature detected by said at least one temperature sensor.

2. Heating system according to clause 1, wherein the system comprises a plurality of temperature sensors connected or connectable to said control unit, wherein at least one working fluid temperature sensor is configured to measure the temperature of the working fluid downstream of the heat pump and an upstream side of the heating tubes, and wherein at least one other working fluid temperature sensor is configured to measure the temperature of the working fluid downstream of the heating tubes.

3. Heating system according to clause 1 or 2, wherein the system comprises a plurality of temperature sensors connected or connectable to said control unit, wherein at least one working fluid temperature sensor is configured to measure the temperature of the working fluid, and wherein at least one water temperature sensor is configured to measure the temperature of water of conducted through at least one water line of the building water system.

4. Heating system according to any of the preceding clauses, wherein the heating system comprises a plurality of water temperature sensors connected or connectable to said control unit, wherein at least one water temperature sensor is configured to measure the temperature of water of conducted through at least one first water line, such as a tap water line, and wherein at least one other water temperature sensor is configured to measure the temperature of water of conducted through at least one second water line, such as a central heating water line.

5. Heating system according to any of the preceding clauses, wherein the system comprises at least one pressure sensor connected or connectable to the control unit, wherein the at least one pressure sensor is configured to measure the pressure of the working fluid.

6. Heating system according to any of the preceding clauses, wherein the system comprises at least one water pressure sensor connected or connectable to the control unit, wherein the at least one water pressure sensor is configured to measure the pressure of water in at least one water line of the building water system.

7. Heating system according to any of the preceding clauses, wherein at least two heating tubes are positioned at a downstream side of the heat pump and at an upstream side of the at least one heat exchanger.

8. Heating system according to any of the preceding clauses, wherein at least two heating tubes are positioned at an upstream side of the heat pump and at a downstream side of the at least one heat exchanger.

9. Heating system according to any of the preceding clauses, wherein at least two heating tubes are connected in parallel orientation in the working fluid line.

10. Heating system according to any of the preceding clauses, wherein a diameter of at least one heating tube, preferably each heating tube is smaller than a diameter of an, preferably each, adjacent conduit of the working fluid line.

11. Heating system according to any of the preceding clauses, wherein at least two heating tubes are connected in parallel orientation in the working fluid line, and wherein the sum of diameters of the parallel heating tubes is larger than a diameter of an, preferably each, adjacent conduit of the working fluid line.

12. Heating system according to any of the preceding clauses, wherein at least two heating tubes are connected in series in the working fluid line.

13. Heating system according to any of the preceding clauses, wherein at least one electrical heating tube is an induction heating tube.

14. Heating system according to clause 13, wherein said induction heating tube comprises at least one coil connected or connectable to an alternating current source, wherein said at least one coil is wound, preferably at a coupling distance, around a electricity conductive tube.

15. Heating system according to clause 13 or 14, wherein said induction heating tube is connected or a connectable to an alternating current source, such as the mains, wherein at least one frequency converter is positioned in between the alternating current source and said induction heating tube, wherein said frequency converter is configured to increase a default frequency value of the alternating current source to a higher frequency value.

16. Heating system according to any of the preceding clauses, wherein at least one electrical heating tube is an electrical resistance heating tube comprising at least one electrical resistance heating element, such as a heating coil, configured to generate heat to be transferred to the working fluid conducted through said heating tube.

17. Heating system according to clause 16, wherein said heating element is connected or connectable to an electrical power source.

18. Heating system according to any of the preceding clauses, wherein the working fluid line comprises at least one heat source, preferably instead of at least one of the at least two heating tubes or in addition to at least one of the at least two heating tubes.

19. Heating system according to any of the preceding clauses, wherein the control unit is configured to individually switch on and off the electrical heating tubes and/or one or more parts of a heating tube, dependent on one or more temperature values measured by one or more temperature sensors, preferably including temperature values relating to the temperature of the working fluid and the water heated and/or to be heated.

20. Heating system according to any of the preceding clauses, wherein the system comprises at least one water temperature sensor is configured to measure the temperature of water of conducted through at least one first water line, such as a tap water line, wherein control unit is configured to switch on at least one electrical heating tube in case the measured water temperature is below a first threshold value and simultaneously or successively to switch on at least one further heating tube in case the measured water temperature is below a second threshold value, wherein said second threshold value is lower than said first threshold value.

21. Heating system according to any of the preceding clauses, wherein the system comprises at least one water temperature sensor is configured to measure the temperature of water of conducted through at least one first water line, such as a tap water line, as well as at least one flow sensor to measure the flow of water through said first water line, wherein control unit is configured to switch on at least one electrical heating tube in case the measured water temperature is below a temperature threshold value and/or in case the measured water flow exceeds a flow threshold value, and wherein the control unit is further configured to simultaneously or successively to switch on at least one further heating tube in case the measured water flow exceeds a, preferably predefined, period of time and/or in case the measured temperature increase over a predefined period of time remains below a temperature threshold value.

22. Heating system according to any of the preceding clauses, wherein the heat pump comprises at least one compressor, at least one condenser, and at least one expansion device, in particular at least one expansion valve, and at least one evaporator, connected by fluid conduits carrying a heat pump fluid, wherein the evaporator is provided with an air intake duct and an air outlet duct, wherein the heat pump further comprises an air fan which is preferably provided in or connected to the air inlet duct.

23. Heating system according to clause 22, wherein the condenser is provided with at least one working fluid duct making part of the working fluid line, wherein said working fluid duct is preferably connected to the heating tubes.

24. Heating system according to any of the preceding clauses, wherein the heat pump comprises a housing, wherein at least two heating tubes are connected to said housing and/or are accommodated within said housing.

25. Heating system according to any of the preceding clauses, wherein said heat pump is connected or connectable to an electrical power source.

26. Heating system according to any of the preceding clauses, wherein the heating system comprises a working fluid pump for pumping said working fluid through the working fluid line.

27. Heating system according to any of the preceding clauses, wherein the heating system comprises at least three individually controllable heating tubes.

28. Heating system according to any of the preceding clauses, wherein the working fluid line is a closed working fluid circuit.

29. Heating system according to any of the preceding clauses, wherein the working fluid line comprises at least one storage container for storing heated working fluid, wherein said storage container is preferably configured for flow-through of working fluid during circulation of working fluid in the working fluid line.

30. Heating system according to clause 29, wherein a part of at least one water line is guided through said storage container for preheating water by said working fluid within said storage container.

31. Heating system according to any of the preceding clauses, wherein the heating system comprises at least one water pump for pumping water at least one water line of the building water system.

32. Heating system according to any of the preceding clauses, wherein the system comprises a plurality of separated water lines of the building water system, wherein each of at least two water lines are connected to a water heat exchanger for heating water by the working fluid.

33. Heating system according to any of the preceding clauses, wherein the system comprises at least one safety circuit configured to detect overheating and/or boiling dry of the working fluid line and for switching off the heat pump and the heating tubes in case overheating and/or boiling dry of the working fluid line is detected, wherein said safety circuit is preferably unconnected to the control unit.

34. Heating system according to any of the preceding clauses, wherein the control unit is a programmable logic controller (PLC) and/or an energy management system (EMS).

35. Heating system according to any of the preceding clauses, wherein the control unit is configured to communicate wirelessly with at least one, preferably each, temperature sensor and/or with the heating tubes.

36. Heating system according to any of the preceding clauses, wherein the system comprises at least one solar power generator for powering the heat pump and the heating tubes.

37. Heating system according to any of the preceding clauses, wherein each heating tube is configured to generate between 1 and 5 KW, preferably between 2 and 4 kW, of heating power.

38. Heating system according to any of the preceding clauses, wherein the assembly of heating tubes is configured to generate at least 2 kW, preferably between 2 and 10 KW, more preferably between 4 and 7 kW, of heating power.

39. Heating system according to any of the preceding clauses, wherein the heat pump is configured to generate between 1 and 5 kW, preferably between 1 and 3.5 kW, of heating power.

40. Heating system according to any of the preceding clauses, wherein the ratio of the power input and the power output of the heat pump is between 6:11 and 1:5.

41. Heating system according to any of the preceding clauses, wherein the ratio of the power input and the power output of the heating system is between 60:61 and 2:3.

42. Kit of parts for a building heating system according to any of the preceding clauses, comprising:

at least one heat pump, at least two working fluid heating tubes connectable, directly of indirectly, to said heat pump, at least one working fluid temperature sensor, and at least one control unit connectable to said at least one temperature sensor, wherein said control unit is configured to individually control the electrical heating tubes and optionally the heat pump at least partially based upon the working fluid temperature detected by said at least one working fluid temperature sensor.

BRIEF DESCRIPTION OF THE DRAWINGS

The invention will be elucidated on the basis of non-limitative exemplary embodiments shown in the following figures, wherein FIG. 1 schematically shows a flow diagram of a first embodiment of the heating system according to the invention, and FIG. 2 schematically shows a flow diagram of a second embodiment of the heating system according to the invention.

Within these figures, similar reference numbers correspond to similar or equivalent elements or features.

DETAILED DESCRIPTION OF THE EMBODIMENTS

Figure 1:
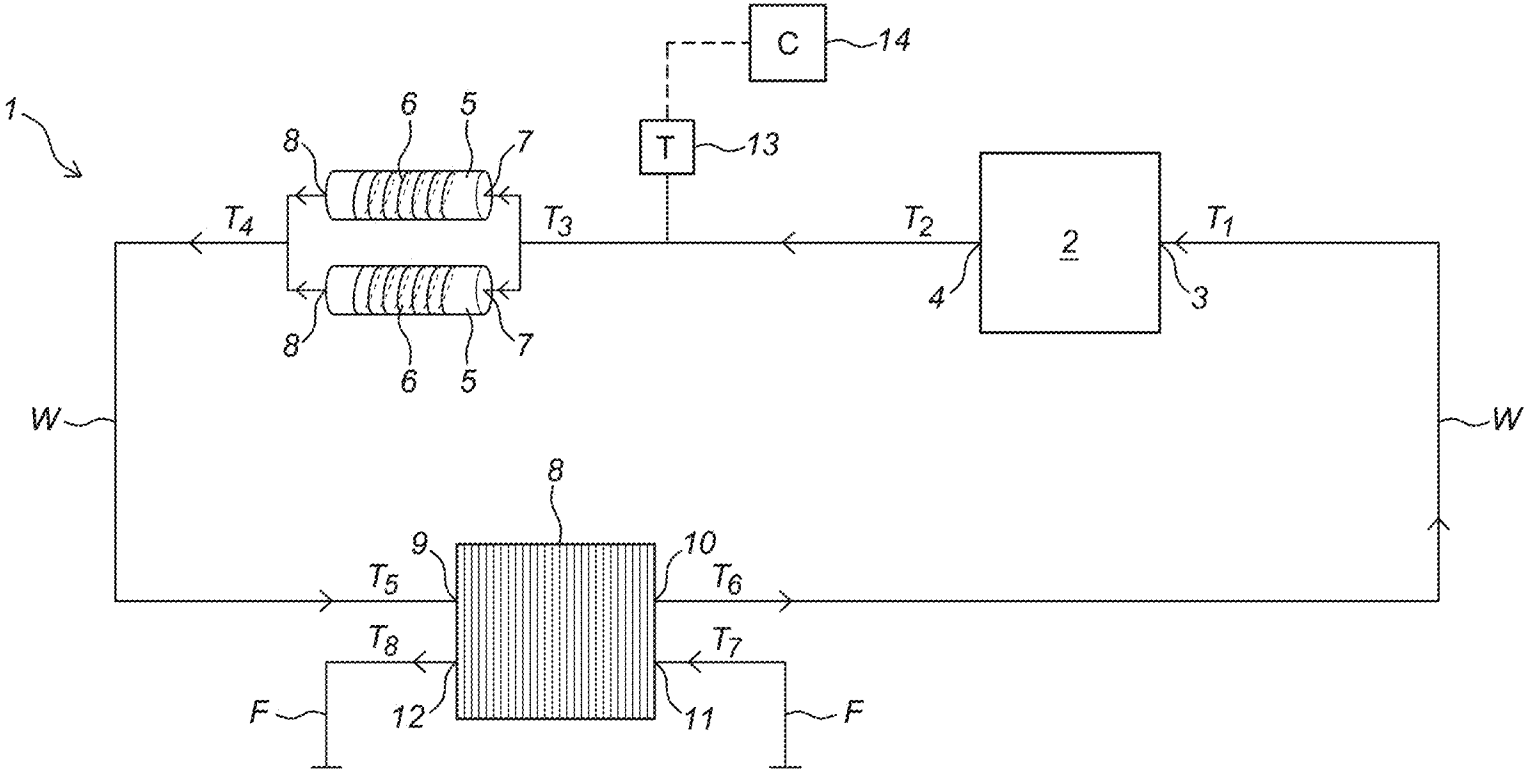

FIG. 1 schematically shows a flow diagram of a heating system 1 according to the invention. The heating system 1 comprises a heat pump 2 connected to a working fluid line comprising a working fluid W. The heat pump 2 comprises an inlet 3 configured to conduct the working fluid W through the heat pump 2 and an outlet 4 configured to discharge the working fluid W from the heat pump 2. The heat pump 2 is configured to heat the working fluid W from a first temperature T1 to a second higher temperature T2.

The heating system 1 of the shown embodiment further comprises two electrical heating tubes 5. Each of the shown heating tubes 5 comprises a first end 7 and a second end 8. The heating tubes 5 are connected to the working fluid line. The heating tubes 5 of the shown embodiment are provided downstream of the heat pump 2. It is, however, imaginable that the heating tubes 5 are provided upstream of the heat pump 2. The heating tubes 5 of the shown embodiment are provided in series with the heat pump 2. The heating tubes 5 allow the working fluid W of the working fluid line to pass, in particular from the first end 7 to the second end 8. The heating tubes 5 of the shown embodiment are connected in parallel orientation in the working fluid line. It is, however, imaginable that the heating tubes 5 are connected in series in the working fluid line. The shown heating tubes 5 each comprise a heating element 6. The heating element 6 of the shown embodiment is at least partially arranged between the first end 7 and the second end 8 of the heating tube 5. It is imaginable that at least one heating tube 5 comprises more than one heating element 6. The heating tubes 5 are configured to heat the working fluid W during flow-through of the working fluid W.

The heating tubes 5 may be configured to heat the working fluid W from a third temperature T3 to a fourth higher temperature T4. The temperature of the working fluid W, which has passed the heating tubes 5, may increase with the number of heating tubes 5 being switched on. The fourth temperature T4 may therefore increase with the number of heating tubes 5 being switched on. It is imaginable that the third temperature T3 is substantially equal to the second temperature T2, in particular when the heating tubes 5 are provided downstream of the heat pump 2. It is imaginable that the fourth temperature T4 is substantially equal to the first temperature T1, in particular when the heat pump 2 is provided downstream of the heating tubes 5.

The shown heating system 1 further comprises a heat exchanger 8 connected to the working fluid line. In the shown embodiment, the heat exchanger 8 is arranged downstream of the heat pump 2 and downstream of the heating tubes 5. The heat exchanger 8 comprises a first inlet 9 configured to conduct the working fluid W through the heat exchanger 8 and a first outlet 10 configured to discharge the working fluid W from the heat exchanger 8. The heat exchanger 8 further comprises a second inlet 11 configured to conduct a fluid F, such as water, through the heat exchanger 8 and a second outlet 12 configured to discharge the fluid F from the heat exchanger 8. The working fluid W and the fluid F are at least partially in heat exchanging contact to at least partially heat the fluid F. It is imaginable that the working fluid W and the fluid F are at least partially in heat exchanging contact within the heat exchanger 8. The working fluid W enters the heat exchanger 8 with a higher fifth temperature T5 and exits the heat exchanger 8 with a lower sixth temperature T6. The heat of the working fluid W is at least partially transferred to the fluid F upon heat exchanging contact of the working fluid W and the fluid F. The fluid F enters the heat exchanger 8 with a lower seventh temperature T7 and leaves the heat exchanger 8 with a higher eight temperature T8 upon heat transfer from the working fluid W to the fluid F.

The heating system 1 further comprises a at least one working fluid temperature sensor 13 configured to measure the temperature of the working fluid W in the working fluid line. In the shown embodiment, the temperature sensor 13 is located between the heat pump 2 and the heating tubes 5, although it may also, additionally or alternatively, be preferred to locate at least one working fluid temperature sensor 13 at a downstream side of the heating tubes 5. Additionally or alternatively, the heating system 1 may comprise one or more water temperature sensors (not shown), which are configured to measure the seventh (water) temperature T7 and/or—often more preferred—the eight (water) temperature T8. The heating system 1 further comprises a control unit 14 directly or indirectly connected to the temperature sensor 13. The control unit 14 is configured to control the heating tubes 5 based upon the temperature detected/measured by the working fluid temperature sensor(s) 13 and/or the water temperature sensor(s). It is imaginable that when the temperature of the working fluid W is below a (predetermined) threshold value one or more heating tubes 5 are switched on to further heat the working fluid W to a desired temperature. Optionally, when the detected temperature of the working fluid W is above a (predetermined) threshold value one or more heating tubes are switched off to not further heat the working fluid W.

Figure 2:
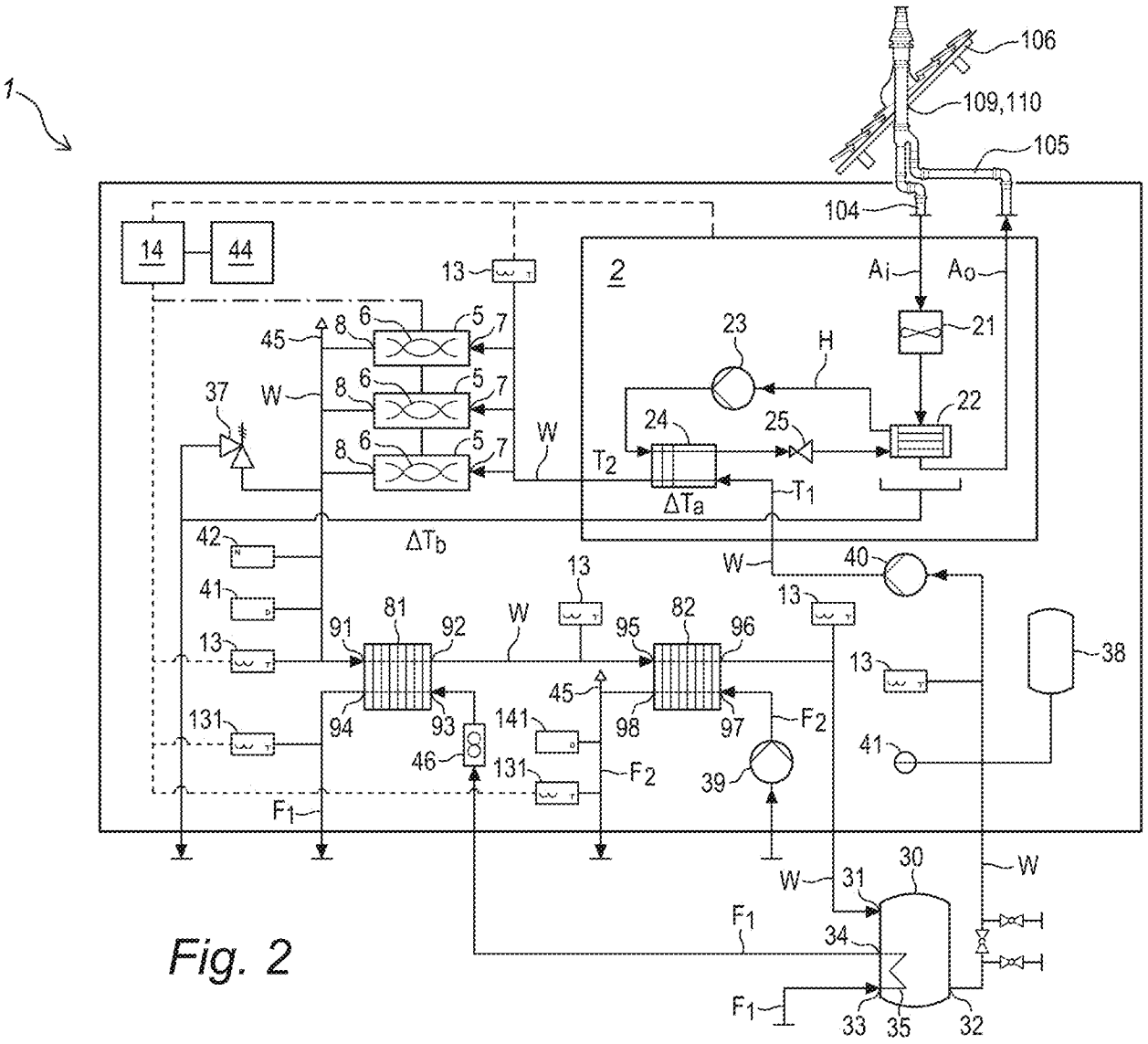

FIG. 2 schematically shows a second embodiment of the heating system 1 according to the invention. The heating system 1 comprises an air source heat pump 2 configured to heat the working fluid W of the working fluid line. It is imaginable that the shown heat pump 2 has replaced a (central heater) boiler by making use of the existing air conducting infrastructure of a heating system of a building. In the shown embodiment, the heat pump 2 is, directly or indirectly, connected to an existing air inlet pipe 105 and/or to an existing air inlet opening 109. In the shown embodiment, the air inlet opening 109 is provided in a roof 106 of the building. The air inlet opening 109 may, however, be provided in any wall of the building. The shown heat pump 2 is further, directly or indirectly, connected to an existing flue gas discharge pipe 104 and/or an existing flue gas outlet opening 110. In the shown embodiment, the existing flue gas outlet opening 110 is provided in a roof 106 of the building. The existing flue gas outlet opening 110 may, however, be provided in any wall of the building. In particular, the air intake duct Ai is connected to the existing flue gas discharge pipe 104 and the air outlet duct Ao is connected to the existing air inlet pipe 105. Therewith, the heat pump 2 is configured to discharge relatively cold air via the existing air inlet pipe 105 and to extract relatively warm or hot air via the existing flue gas discharge pipe 104. This configuration is favourable, since the existing air inlet pipe 105 is designed to conduct relatively cold air and the existing flue gas discharge pipe 104 is designed to conduct relatively hot gas. It is, however, also imaginable that the air intake duct Ai is connected to the existing air inlet pipe 105 and the air outlet duct Ao is connected to the existing flue discharge pipe 104. The heat pump 2 comprises a compressor 23, a condenser 24, an expansion valve 25, and an evaporator 22 which are connected by fluid conduits carrying a heat pump fluid H. The evaporator 22 is provided with an air intake duct Ai and an air outlet duct Ao. The air intake duct Ai is provided with an air fan 21 or a ventilator which is preferably provided in or connected to the air inlet duct Ai. The air fan 21 is configured to direct relatively hot air into the heat pump 2. The evaporator 22 is configured to at least partially heat the heat pump fluid H, for example by absorbing heat from the relatively hot air. The shown condenser 24 is provided with an working fluid duct configured to connect the heat pump 2 to the working fluid line. The heat pump fluid H is at least partially in heat exchanging contact with the working fluid W, preferably at least partially in the condenser 24, to heat the working fluid W from a first temperature T1 to a second higher temperature T2. The temperature difference ΔTa between the first temperature T1 and the second temperature T2 is preferably maximal 40 degrees Celsius.

Downstream of the heat pump 2, the shown heating system 1 comprises three heating tubes 5. The heating tubes 5 are connected to the working fluid line W in a parallel orientation.

Between the heat pump 2 and the heating tubes 5 the heating system comprises a temperature sensor 13 configured to measure the temperature of the working fluid W before entering the heating tubes 5. The temperature sensor 13 is connected or connectable to the control unit 14. The heating tubes 5 are preferably configured to cooperatively heat the working fluid W up to 95 degrees Celsius. A temperature difference ΔTb may be defined by the difference in temperature of the working fluid W prior to entering the heating tubes 5 and the temperature of working fluid W after flow-through the heating tubes 5. Preferably, the maximum temperature difference ΔTb is 85 degrees Celsius. The working fluid W is preferably heated by the heating tubes 5 and the heat pump 2. Preferably, the maximum temperature of the working fluid W passed through both the heating tubes 5 and the heat pump is 95 degrees Celsius.

The shown heating system 1 further comprises working fluid sensors 13, 41. The temperature sensors 13 are provided at various locations configured to measure the temperature of the working fluid W. A temperature sensor 13 may for example be provided downstream of the heating tubes 5 and upstream of a first heat exchanger 81. The shown heating system 1 furthermore comprises a pressure sensor 41 configured to measure the pressure of the working fluid W in the working fluid line. The pressure sensor 41 is, directly or indirectly, connected or connectable to the control unit 14. The shown pressure sensor 41 is provided downstream of the heating tubes 5 and upstream of the heat exchangers 81. It is imaginable, that when the pressure measured by the pressure sensor 41 is above a threshold value that a safety valve 37 opens to decrease the pressure in the working fluid line. The shown heating system 1 further comprises a safety circuit 42 configured to detect overheating and/or boiling dry of the working fluid W in the working fluid line. In case overheating and/or boiling dry of the working fluid W in the working fluid line is detected, the safety circuit 42 is configured to switch off the heat pump 2 and/or at least one of the heating tubes 5.

The control unit 14 is configured to modularly control the heating tubes 5 and optionally the heat pump 2, preferably based upon the input of at least one temperature sensor 13, 131. For example, if the measured temperature of working fluid W measured by the temperature sensor 13 located upstream from the heating tubes 5 is below a threshold value the control unit may be configured to switch on one or multiple heating tubes 5 to further heat the working fluid W to a desired temperature.

The shown control unit 14 is connected or connectable to a an external device 44, such as a display to allow persons or users to communicate building heating system related data and/or to monitor the status of the heating system.

Downstream of the heating tubes 5 the heating system 1 of the shown embodiment comprises two exchangers 81, 82 which are serially connected to the working fluid line. A first heat exchanger 81 comprises a first inlet 91 and a first outlet 92 configured to be connected to the working fluid line. The first heat exchanger 81 further comprises a second inlet 93 and a second outlet 94 connected or connectable to a first fluid line comprising a first fluid F1.

Preferably, the first fluid line is a tap water line comprising tap water. Preferably, the tap water line comprising tap water is heated in the first heat exchanger, provided upstream from the second heat exchanger, to allow the tap water to be heated relatively quickly. The first heat exchanger 81 is configured to transfer heat from the working fluid W to the first fluid F1, such as water, of the first fluid line. The temperature of the first fluid F1 prior to entering the first heat exchanger 81 may be between 10-65 degrees Celsius. It is imaginable that the first fluid F1 is heated by the first heat exchanger 81 up to 65 degrees Celsius. In the shown embodiment, the first fluid line comprises a flow sensor or flow switch 46. The flow switch 46 is arranged upstream of the first heat exchanger 81. The flow switch 46 may be configured to monitor the flow rate and/or the pressure of the first fluid F1 in the first fluid line.

Preferably, the flow switch 46 is configured to activate the first heat exchanger 81 when the first fluid F1 exceeds a predetermined flow rate. It is imaginable that a flow switch 46 is (also) provided in a second fluid line and/or in the working fluid line. In the shown embodiment, a water temperature sensor 131 is provided to measure the temperature of the first fluid F1. The shown temperature sensor 131 is provided downstream of the first heat exchanger 81. The temperature sensor 131 may be connected or connectable to the control unit 14, wherein the control unit 14 is configured to control the heat first exchanger 81 based upon the temperature detected by the temperature sensor 131. For example, if the measured temperature of the first fluid F1 measured by the temperature sensor 131 located upstream of the first heat exchanger 81 is below a threshold value the control unit may be configured to switch on one or multiple heating tubes 5 to (further) heat the first fluid F1 to a desired temperature.

Downstream of the first heat exchanger 81, the heating system 1 of the shown embodiment comprises a second heat exchanger 82. Between the first heat exchanger 81 and the second heat exchanger 82 a temperature sensor 13 is provided to measure the temperature, and optionally to monitor a possible temperature decay. The second heat exchanger 82 comprises a first inlet 95 and a first outlet 96 configured to be connected to the working fluid line. The second heat exchanger 82 further comprises a second inlet 97 and a second outlet 98 connected or connectable to a second fluid line comprising a second fluid F2. Preferably, the second fluid line is a central heating water line comprising central heating water. The second heat exchanger 82 is configured to transfer heat from the working fluid W to the second fluid F2, such as water, of the second fluid line. The temperature of the second fluid F2 prior to entering the second heat exchanger 82 may be between 10-65 degrees Celsius. It is imaginable that the second fluid F2 is heated by the second heat exchanger 82 up to 65 degrees Celsius. The second fluid line further comprises a pump 39 configured to pump the second fluid F2 in the second heat exchanger 82. In the shown embodiment, a water temperature sensor 131 is provided to measure the temperature of the second fluid F2. The shown temperature sensor 131 is provided downstream of the second heat exchanger 82. The temperature sensor 131 may be connected or connectable to the control unit 14, wherein the control unit 14 is configured to control the second first exchanger 82 based upon the temperature detected by the temperature sensor 131. Additionally, a pressure sensor 141 may be provided in the second fluid line to measure the pressure of the second fluid F2. In case, for example, the measured pressure of the second fluid F2 is below a threshold value a signal is given by the control unit to refill the second fluid line with the second fluid F2. The shown pressure sensor 141 is provided downstream of the second heat exchanger 82. A temperature sensor 13 is present downstream of the second heat exchanger 82 and upstream of a storage container 30, to measure the temperature of the working fluid W, and optionally to monitor and optionally to monitor a possible temperature decay.

The working fluid line further comprises a vent 45 configured to vent the working fluid line of air (bubbles) or gas (bubbles). The first fluid line and/or second fluid line may comprise a vent 45 configured to vent the first fluid line and/or the second fluid line of air (bubbles) or gas (bubbles).

The shown heating system 1 further comprises a storage container 30, such as a buffer tank. The shown storage container 30 comprises a first inlet 31 for conducting the working fluid W to the storage container 30 and a first outlet 32 for discharging the working fluid W from the storage container 30. The storage container 30 is configured to store the heated working fluid W. The storage container 30 further comprises a second inlet 33 and a second outlet 35 connected or connectable to the first fluid line. A part of the first fluid line is guided through the storage container 30, in particular at least between the second inlet 33 and the second outlet 34 of the storage container 30. The shown storage container 30 is configured to preheat the first fluid F1 by transferring heat from the heated working fluid W to the first fluid F1. It is imaginable that the storage container 30 is configured to heat the first fluid F1 at least to approximately 10 degrees Celsius, preferably up to approximately 75 degrees Celsius. It is imaginable that the temperature of the working fluid W is maximal 95 degrees Celsius prior to entering the storage container 30. The temperature of the working fluid W may decrease to 10 degrees Celsius when discharged from the storage container 30, in particular after heat has been transferred to the first fluid F1. Optionally, the first fluid line guided through the storage container 30 comprises a coiled portion 35. The coiled portion 35 increases the length of the conduct part, and hence the heat transfer capacity from the working fluid W to the first fluid F1. The shown storage container 30 is provided upstream of the heat pump 2 and the heating tubes 5. The shown heating system 1 further comprises a second storage container 38 configured to store working fluid W. Additionally, the shown heating system 1 comprises a working fluid pump 40 configured to pump the working fluid W in the working fluid line.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

It will be apparent that the invention is not limited to the working examples shown and described herein, but that numerous variants are possible within the scope of the attached claims that will be obvious to a person skilled in the art.

The ordinal numbers used in this document, like "first", "second", "third" and "fourth", are used only for identification purposes. Hence, the use of the expression "third temperature" does therefore not necessarily require the co-presence of a "first temperature". The expression "heating tube" may be replaced by the expression "auxiliary heat source".

The verb "comprise" and conjugations thereof used in this patent publication are understood to mean not only "comprise", but are also understood to mean the phrases "contain", "substantially consist of", "formed by" and conjugations thereof.

The invention claimed is:

1. A building heating system, comprising:

at least one air source heat pump configured to transfer heat from air to a working fluid conducted through a working fluid line, said working fluid line comprises at least two electrical heating tubes configured to heat said working fluid during flow-through of said working fluid, wherein each of said heating tubes is, directly or indirectly, connected or connectable to said heat pump, and wherein said working fluid line is connected or connectable to at least one water heat exchanger for transferring heat from said working fluid to water conducted through at least one water line of a building water system, at least one temperature sensor configured to measure the temperature of the working fluid and/or water conducted through at least one water line, and at least one control unit connected or connectable to said at least one temperature sensor, wherein said control unit is configured to individually control the electrical heating tubes based upon the temperature detected by said at least one temperature sensor.

2. The building heating system according to claim 1, wherein the control unit is configured to individually control the electrical heating tubes and the heat pump based upon the temperature detected by said at least one temperature sensor.

3. The building heating system according to claim 1, further comprising a plurality of temperature sensors connected or connectable to said control unit, wherein at least one working fluid temperature sensor is configured to measure the temperature of the working fluid downstream of the heat pump and an upstream side of the heating tubes, and wherein at least one other working fluid temperature sensor is configured to measure the temperature of the working fluid downstream of the heating tubes.

4. The building heating system according to claim 1, further comprising a plurality of temperature sensors connected or connectable to said control unit, wherein at least one working fluid temperature sensor is configured to measure the temperature of the working fluid, and wherein at least one water temperature sensor is configured to measure the temperature of water of conducted through at least one water line of the building water system.

5. The building heating system according to claim 1, further comprising a plurality of water temperature sensors connected or connectable to said control unit, wherein at least one water temperature sensor is configured to measure the temperature of water of conducted through at least one first water line, and wherein at least one other water temperature sensor is configured to measure the temperature of water of conducted through at least one second water line.

6. The building heating system according to claim 1, wherein at least two heating tubes are positioned at a downstream side of the heat pump and an upstream side of the at least one heat exchanger.

7. The building heating system according to claim 1, wherein at least two heating tubes are connected in parallel orientation in the working fluid line, and wherein the sum of diameters of the parallel heating tubes is larger than a diameter of an adjacent conduit of the working fluid line.

8. The building heating system according to claim 1, wherein at least one electrical heating tube is an induction heating tube, and wherein said induction heating tube is connected or a connectable to an alternating current source.

9. The building heating system according to claim 8, wherein at least one frequency converter is positioned in between the alternating current source and said induction heating tube, and wherein said frequency converter is configured to increase a default frequency value of the alternating current source to a higher frequency value.

10. The building heating system according to claim 1, wherein the control unit is configured to individually switch on and off the electrical heating tubes and/or one or more parts of a heating tube, dependent on one or more temperature values measured by one or more temperature sensors.

11. The building heating system according to claim 1, further comprising at least one water temperature sensor configured to measure the temperature of water conducted through at least one first water line, wherein the control unit is configured to switch on at least one electrical heating tube in case the measured water temperature is below a first threshold value and simultaneously or successively to switch on at least one further heating tube in case the measured water temperature is below a second threshold value, wherein said second threshold value is lower than said first threshold value.

12. The building heating system according to claim 1, wherein the heat pump comprises a housing, wherein at least two heating tubes are connected to said housing and/or are accommodated within said housing.

13. The building heating system according to claim 1, further comprising at least one alternative auxiliary heating source in addition to the heat pump and in addition to or instead of at least one heating tube.

14. The building heating system according to claim 1, wherein the working fluid line comprises at least one storage container for storing heated working fluid, wherein a part of at least one water line is guided through said storage container for preheating water by said working fluid within said storage container.

15. The building heating system according to claim 1, further comprising a plurality of separated water lines of the building water system, wherein each of at least two water lines are connected to at least one water heat exchanger for heating water by the working fluid.

16. The building heating system according to claim 1, further comprising comprises at least one safety circuit configured to detect overheating and/or boiling dry of the working fluid line and for switching off the heat pump and the heating tubes in case overheating and/or boiling dry of the working fluid line is detected, wherein said safety circuit is preferably unconnected to the control unit.

17. The building heating system according to claim 1, further comprising at least one water temperature sensor is configured to measure the temperature of water of conducted through at least one first water line as well as at least one flow sensor to measure the flow of water through said first water line, wherein control unit is configured to switch on at least one electrical heating tube in case the measured water temperature is below a temperature threshold value and/or in case the measured water flow exceeds a flow threshold value, and wherein the control unit is further configured to simultaneously or successively to switch on at least one further heating tube in case the measured water flow exceeds a predefined, period of time and/or in case the measured temperature increase over a predefined period of time remains below a temperature threshold value.

18. A kit of parts for a building heating system according to claim 1, comprising:

at least one heat pump, at least two working fluid heating tubes connectable, directly or indirectly, to said heat pump, at least one working fluid temperature sensor, and at least one control unit connectable to said at least one temperature sensor, wherein said control unit is configured to individually control the electrical heating tubes at least partially based upon the working fluid temperature detected by said at least one working fluid temperature sensor.

19. A computer-implemented method for controlling the building heating system according claim 1, comprising a step of operating the control unit to individually control and switch on and/or off, one or more electrical heating tubes and optionally the heat pump, at least partially based upon at least one temperature detected by said at least one temperature sensor.

* * * * *